252-99 AU 166 EX
4/1/80 XR 4,195,974

United States Patent [19]
Kothe et al.
[11] 4,195,974
[45] Apr. 1, 1980

[54] DESIZING AND BLEACHING OF TEXTILE GOODS

[75] Inventors: Wilfried Kothe, Ludwigshafen; Wolfgang Grunwald, Frankenthal, both of Fed. Rep. of Germany

[73] Assignee: BASF Aktiengesellschaft, Fed. Rep. of Germany

[21] Appl. No.: 930,811

[22] Filed: Aug. 3, 1978

[30] Foreign Application Priority Data

Aug. 9, 1977 [DE] Fed. Rep. of Germany ..... 2735816

[51] Int. Cl.² ..... D01C 3/02; D06L 1/06
[52] U.S. Cl. ..... 8/138; 252/99; 252/105; 252/175
[58] Field of Search ..... 8/138; 252/99, 105

[56] References Cited

U.S. PATENT DOCUMENTS 4,082,683 4/1978 Galesloot ..... 252/105

FOREIGN PATENT DOCUMENTS 1130408 12/1959 Fed. Rep. of Germany .
1135857 9/1962 Fed. Rep. of Germany .
951290 3/1964 United Kingdom .

OTHER PUBLICATIONS

Casserly, J. J., American Dyestuff Reporter, Jul. 3, 1967, pp. 23–24.

*Primary Examiner*—A. Lionel Clingman
*Attorney, Agent, or Firm*—Keil & Witherspoon

[57] ABSTRACT

A process for desizing and bleaching textile goods containing, or consisting of, cellulose, by simultaneous enzymatic desizing and pretreatment with a solution of sodium dithionite and a conventional heavy metal complexing agent in the presence of a buffer system at pH 6–9 and subsequent conventional peroxide bleaching in the presence of little or no silicate as a stabilizer. The process improves the bleaching effect and the economics and reduces the risk of fiber damage or destruction or of silicate deposits without an additional treatment stage.

9 Claims, No Drawings

DESIZING AND BLEACHING OF TEXTILE GOODS

The present invention relates to a process for desizing and bleaching textile goods containing, or consisting of, cellulose and sized with starch by enzymatic desizing.

Hydrogen peroxide is the common oxidizing agent for bleaching natural fibers, especially cellulosic fibers. It permits broad variation of reaction time, temperature and process combinations, and the desired bleaching effects are achieveable without substantial damage to the material. Admittedly it is known that traces of heavy metals, especially iron, copper and manganese, interfere. In terms of amount, iron predominates; it may have its origin in the textile goods themselves or may originate from the processing equipment and storage vessels or from chemicals (for example sodium hydroxide solution or waterglass). The interfering effect of these heavy metal ions can range from (relatively harmless) auto-decomposition of the peroxide, resulting in a depletion of the necessary oxidizing agent in the liquor, to a lowering of the average degree of polymerization (DP) of the cotton and finally to local destruction ("catalyst holes") and hence complete loss of value of the textile goods.

For this reason, stabilizers are added to the peroxide bleaching baths. Their mechanism of action is not yet fully understood. Magnesium silicate has proved to be the most effective stabilizer. However the latter tends to lead to the notorious fault of silicate deposits—which are very difficult to remove—on the textile goods and on the rollers. It has therefore long been desirable to carry out the process with very little silicate, if any. Examples of other stabilizers are polyphosphates, phosphonic acids, aminopolycarboxylic acids, hydroxyalkylaminopolycarboxylic acids, hydroxycarboxylic acids and protein condensation products, such as lecithin derivatives. Their effect is sufficient for normal cases, ie. in the absence of substantial amounts of heavy metal impurities and especially in the absence of such impurities in the form of relatively coarse, i.e., undissolved, particles, but the achieveable action does not represent an optimum. In the presence of substantial amounts of soil particles containing heavy metal, and especially in the presence of undissolved particles of this type, the action of the above compounds is inadequate and great difficulties often arise because the hazard is only recognized when it is too late, i.e. the presence of undissolved particles containing heavy metal as a rule only manifests itself through the catalyst holes formed in the textile goods. This has hitherto only been reliably avoided by means of an additional process step, namely an acid treatment, preferably with oxalic acid, preceding the bleaching. However, oxalic acid is toxic and if other acids, for example mineral acids, are used a pH of less than 3 is required to dissolve rust, and at such a low pH there is a risk of damage to the fibers, especially at elevated temperatures. In addition, a strongly acid treatment to precede the alkaline peroxide bleaching entails thorough and therefore expensive rinses. Such intermediate rinses constitute a great nuisance, especially in the continuous processes which nowadays are of principal importance.

The present invention seeks to provide a pretreatment which is simple to carry out and can be integrated into modern continuous finishing processes, by which pretreatment the subsequent peroxide bleaching can, in every respect, be made safer, more economical and more effective. In order that this pretreatment shall not require any additional process steps, it should be capable of combination with enzymatic desizing, the most widely used desizing process. We have found that good results may be achieved by carrying out simultaneous enzymatic desizing and pretreatment with a solution of a dithionite (hereinafter also referred to as "hydrosulfite") and a conventional heavy metal complexing agent in the presence of a buffer system at pH 6–9 and subsequent peroxide bleaching in the presence of little or no silicate as stabilizer.

According to the invention, therefore, there is provided a process for bleaching and desizing textile goods containing, or consisting of, cellulose and sized with starch, by enzymatic desizing and subsequent treatment with hydrogen peroxide, wherein the desizing bath contains, in addition to amylase in an amount to achieve desizing, e.g. a conventional amount, with or without other conventional components, (a) from 0.1 to 10% by weight of a dithionite (other than a heavy metal dithionite), e.g. sodium dithionite, (b) from 0.2 to 10% by weight of a heavy metal complexing agent selected from aminopolycarboxylic acids and salts, polyphosphates and phosphonic acids and salts, and (c) from 0.05 to 5% by weight of a buffer capable of maintaining the pH of the desizing bath which has been brought to 6–9, within the same range, the above percentages being based on the weight of textile goods, and wherein, during the subsequent peroxide bleaching, at most 5 ml of waterglass of 38° Be strength, or a corresponding amount of any other silicate source, are employed per liter of bleaching liquor.

The new process generally improves the bleaching effect and the economics and reduces the risk of fiber damage or destruction or of silicate deposits without entailing an additional treatment stage.

For the process the components (a), (b) and (c) are usually employed in a weight ratio a:b:c of 1:(0.25–4):(0.25–1.5), preferably 1:(0.5–2):(0.5–1).

In the case of the dithionite (component a), the cation is immaterial, provided it is not a heavy metal ion. Sodium is particularly referred to in the present instance as representative of, for example, alkali metals, alkaline earth metals and ammonium, because $Na_2S_2O_4$ is the commonest and cheapest dithionite.

Amongst complexing agents (component b), the aminopolycarboxylic acids are preferred. Examples include nitrilotriacetic acid, ethylenediaminetetraacetic acid, diethylenetriaminepentaacetic acid, β-hydroxyethylaminodiacetic acid, N,N-di-(β-hydroxyethyl)-glycine, 1,3-propylenediaminetetraacetic acid, 1,2-propylenediaminetetraacetic acid, N-β-hydroxyethylethylenediaminetriacetic acid, 2-hydroxypropylene-1,3-diaminetetraacetic acid, di-(β-aminoethyl)-ether-tetraacetic acid, glycol bis-(β-aminoethyl)ether-tetraacetic acid, cyclohexylene-1,2-diaminetetraacetic acid and their alkali metal salts and alkaline earth metal salts, especially the magnesium salts. Other suitable complexing agents are the polymetaphosphates (e.g. trimetaphosphates, tetrametaphosphates and hexamethaphosphates) and the phosphonic acids, e.g. 1-hydroxyethane-1,1-diphosphonic acid, and their salts.

The use of dithionite as the reducing agent requires employing a buffer system, because during the oxidation of dithionite, for example according to the equation

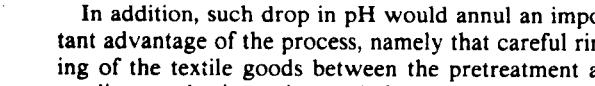

$$Na_2S_2O_4 + Fe_2(SO_4)_3 \rightarrow Na_2SO_4 + 2FeSO_4 + 2SO_2$$

sulfurous acid is produced, i.e. the pH drops. Buffering must be used so as to prevent the treatment bath from turning acid, in order to prevent the auto-decomposition of the dithionite, prevent the pH from going outside the optimum range for complexing, and prevent an odor of $SO_2$.

In addition, such drop in pH would annul an important advantage of the process, namely that careful rinsing of the textile goods between the pretreatment according to the invention and the subsequent alkaline peroxide bleaching stage is not necessary, whilst this would be necessary on going from an acid pH to an alkaline value.

The most suitable buffer system (component c) has proved to be a mixture of sodium sulfite or potassium sulfite, on the one hand, and sodium pyrosulfite or potassium pyrosulfite, or sodium bisulfite or potassium bisulfite, on the other, the two components being used in about equal amounts. This is an economical mixture to use and also contributes to the reduction potential of the solution. Of course other buffer systems suitable for buffering in the pH range from 6 to 9 may also be used. Monopotassium phosphate/disodium phosphate and monopotassium phosphate/sodium hydroxide should be mentioned especially as examples of such systems. Other systems suitable in principle are boric acid/borax, borax by itself and boric acid/sodium hydroxide; however, these are unlikely to become of practical importance. Advantageously, from about 25 to 50% by weight of buffer substances, based on the sum of components a+b (hydrosulfite+complexing agent), are used.

As a rule, cotton is sized with starch and must subsequently be desized. This is in most cases done by enzymatic degradation of the starch because it is the gentlest method of treating the fibers. Bacterial amylase, malt amylase or pancreatic amylase may be used as the desizing agent. Because of the lower heat sensitivity, the two first-mentioned amylaes are preferred in the present instance, where relatively high temperatures are used. They can normally be employed at up to about 75° C. There are also special processes where higher temperatures, up to about 100° C., are used. The amount of amylase used in the invention may vary within the usual range of from about 2 to 8 g/l.

The presence of calcium ions is recommended for enzymatic desizing (cf., for example, the leaflets issued by the various manufacturers of amylase, and the article by F. Svoboda, Textilindustrie 66 (1964), 759) and according to K. Ramaszeder, Spinner Weber Textilveredlung 1965,136, copper ions also activate amylase. It was to be expected from this, and from the generally high sensitivity of the enzymes to the addition of foreign chemicals (cf. H. Jalke, Melliand Textilberichte No. 5 (1965), 496) that the pretreatment with components a, b and c would not be capable of combination with the enzymatic desizing since complexing agents also mask calcium ions. Surprisingly, however, it does not prove possible to combine these steps without in any way detracting from the activity of the amylase. Hence, the process according to the invention does not require any additional process step.

The desizing pretreatment may be carried out with a long or, preferably, short liquor. If there is a locally high concentration of catalyst (e.g. rust particles) it is advisable to carry out the treatment according to the invention with a long liquor (with a ratio greater than 1:1) using from 2 to 10%, based on textile weight, of both the hydrosulfite and the complexing agent; the process can be carried out continuously (in a washing machine) or batchwise (using a jigger, winch vat or dyeing machine). Depending on the degree of soiling, the liquor length and the residence time, concentrations of from about 2 to 30, preferably from 3 to 10, g of the mixture a+b+c of the invention are usually employed per liter of desizing bath. If the material is more or less uniformly soiled, a short liquor (liquor ratio about 1:1) can be employed, i.e. the padding process may be used. From 0.1 to 10%, preferably 0.1 to 2%, of hydrosulfite and from 0.2 to 10%, preferably 0.2 to 2%, of complexing agent, each based on textile weight, are used.

Outside the pH range from 6 to 9, the complexing action of the complexing agents, and hence their solubilizing and mashing action on sparingly soluble heavy metal compounds, and/or the activity of the amylase, decrease. Of course, a certain effect is achieveable even outside the stated range. The pH range from 6 to 7.5 is preferred.

The above enzymatic desizing with simultaneous pretreatment with components a to c is usually carried out whilst observing the conventional conditions for enzymatic desizing (from about 2 minutes to about 24 hours at from about 100° to 20° C., preferably from 2 to 24 hours at from 75° to 20° C.), in the presence or absence of conventional additives (e.g. surfactants, common salt, magnesium salts and calcium salts). It precedes a treatment with hydrogen peroxide which may be a conventional treatment in the presence of the conventional additives for this purpose, except that at most 5 ml of waterglass of 38° Be strength or a corresponding amount of any other silicate source is present per liter of bleaching liquor. In this way, the danger of silicate deposits is substantially avoided. It is best to dispense entirely with the addition of a silicate and instead to use a conventional organic stabilizer, for example one or more of those mentioned at the outset. As a result of the pretreatment according to the invention, their stabilizing action is entirely adequate.

Although the precise conditions of the peroxide stage are not part of the characterizing features of the present inventions, except in respect of the stated upper limit of the silicate content, the conventional conditions for the peroxide stage, which may be used in the process of the invention, will be briefly outlined:

hydrogen peroxide concentration: from 1 to 30 g/l
treatment time: from 1 minute to 48 hours
treatment temperature: from room temperature to 150° C.
pH: a treatment with hydrogen peroxide is in principle possible over a wide pH range. However, in the context of the pretreatment according to the invention only alkaline peroxide bleaching is of interest.

Examples of conventional additives, in addition to the above stabilizers for hydrogen peroxide, are additives which prevent silicate deposits, e.g. polyacrylic acid in combination with a quaternary hydroxyalkylammonium salt, preferably with a phosphonic acid also present. Others to be mentioned are anti-foam agents, surfactants, optical brighteners stable to peroxide and finally, an alkali metal hydroxide, which is an essential ingredient but is self-evident for an alkaline treatment.

The process according to the invention is applied to textiles, i.e. knitted fabrics and especially woven fabrics, of cellulose and of blends thereof with other natural fibers or with synthetic fibers, especially polyester fibers.

Overall, the process according to the invention can be integrated easily, i.e. without substantial expenditure on equipment, or expenditure of time, into conventional finishing practice, and in particular into modern continuous processes. The reductive pretreatment during desizing is an excellent preparation of the fibers for the subsequent peroxide bleaching, so that improved whiteness is achieved. At the same time, the peroxide bleaching gives higher degrees of polymerization than hitherto attained, and reliably avoids catalyst holes. Furthermore, losses of hydrogen peroxide due to autodecomposition are less; this in turn results in improved bleaching and greater economy. All these important advantages are achieved simultaneously, without an additional process step and without loss of time. According to the prior art, greater whiteness was always necessarily associated with greater damage to the fiber, or reductive bleaching had to be carried out, in additional process steps, after the oxidative bleaching.

In the Examples, parts and percentages are by weight.

EXAMPLE 1

An unbleached catalyst-containing cotton nettle sized with potato starch and weighing 150 g/m$^2$ was subjected to a desizing pretreatment for 2 hours at 70° C. and pH 7.1, using a liquor ratio of 40:1, by means of a mixture comprising

- 5 g/l of Diaferman A (pancreatic amylase)
- 1 g/l of hydrosulfite
- 1.5 g/l of sodium nitrilotriacetate
- 0.5 g/l of sodium bisulfite $NaHSO_3$ and
- 0.5 g/l of sodium sulfite;

the fabric was rinsed hot once and was then subjected to a two hour pad-roll bleaching treatment at from 95° to 98° C., using

- 20 ml/l of 35% strength hydrogen peroxide
- 3 g/l of sodium hydroxide
- 5 ml/l of waterglass of 38° Be strength
- 3 g/l of the magnesium salt of ethylenediaminetetraacetic acid (EDTA) and
- 3 g/l of nonylphenol oxyethylated with 10 moles of ethylene oxide.

The influence of removing the catalyst (gentler treatment of the fiber, and higher whiteness) compared to untreated goods is clearly discernible, whilst at the same time there is no effect on the enzymatic activity and hence on the degree of desizing.

EXAMPLE 2

(a) Comparative experiment according to the prior art:

Unbleached cotton cloth intended for bedlinen and weighing 215 g/m$^2$ was impregnated, after convential enzymatic desizing, with a bleaching liquor of the formulation shown below (the wet pick-up being 100%):

- 30 ml/l of 50% strength hydrogen peroxide
- 16 ml/l of sodium hydroxide solution of 50° Be strength
- 20 ml/l of waterglass of 38° Be strength
- 3 g/l of the magnesium salt of EDTA
- 1 g/l of nonylphenol oxyethylated with 10 moles of ethylene oxide The fabric was bleached for 10 minutes in a U-box at 100° C. and then washed and dried. In addition to silicate deposits in the machines and on the goods, catalyst damage was frequently encountered both in repeated experiments and in practical operation.

(b) A remedy was provided by the following treatment according to the invention, at pH 7:

The singed goods were impregnated at about 70° C. (100% wet pick-up) with:

- 5 g/l of BIOLASE PC 20 (bacterial amylase)
- 4 g/l of hydrosulfite
- 2 g/l of the sodium salt of 1-hydroxyethane-1,1-diphosphonic acid
- 1 g/l of disodium hydrogen phosphate
- 0.1 g/l of potassium dihydrogen phosphate
- 1 g/l of nonylphenol oxyethylated with 10 moles of ethylene oxide After a residence time of 16 hours at room temperature, the fabric was washed, and impregnated wet-on-wet with a bleaching liquor of the following formulation:

- 30 ml/l of 50% strength hydrogen peroxide
- 16 ml/l of sodium hydroxide solution of 50° Be strength
- 5 ml/l of waterglass of 38° Be strength
- 3 g/l of the magnesium salt of EDTA
- 2 g/l of nonylphenol oxyethylated with 10 moles of ethylene oxide After a further 12 minutes' residence time in the U-box at 100° C., followed by washing, the data shown below were obtained:

| Result: | Whiteness Reflectance Zeiss Elrepho, Filter R 46T % | Degree of polymerization | Desizing, measured by the Tegewa method + |
|---|---|---|---|
| Unbleached goods | 51.8 | 2,340 | 1 |
| Pad-roll bleaching after desizing pretreatment (process according to the invention) | 83.7 | 2,070 | 9 |
| Pad-roll bleaching of conventionally desized, non-pretreated goods (comparative experiment) | 77.2 | 1,675 | 9 |

* cf. Melliand Textilber. 36 (1955), 1293–1294

A Tegewa value of 1 means no desizing

A Tegewa value of 9 means complete desizing

| | Whiteness Reflectance (%) | Absorbency (DIN 53 924) (s/cm) | Degree of polymerization | Desizing, measured by the Tegewa method |
|---|---|---|---|---|
| a) Comparative experiment: desized according to the prior art, and bleached | 82.2 | 22.2 | 2.240 | 9 |
| b) Subjected to a desizing pretreatment in accordance with the invention, and bleached | 87.0 | 15.4 | 2.115 | 9 |

For the same peroxide availability, and a reduced amount of waterglass, a very much brighter fabric was obtained, with a comparable DP value, no catalyst damage, and no silicate deposits.

EXAMPLE 3

A starch-sized jute fabric weighing 340 g/m$^2$ was treated for 2 hours at pH 7.4 and 70° C., using a liquor ratio of 40:1, with the following composition:

3 g/l of ENZYLASE FL (bacterial amylase)
2 g/l of hydrosulfite
0.5 g/l of sodium tripolyphosphate
1 g/l of boric acid
0.05 g/l of sodium hydroxide Subsequent peroxide bleaching with 25 m/l of 35% strength hydrogen peroxide
4 g/l of magnesium salt of EDTA for 2 hours at 98° C., using a liquor ratio of 40:1 and distilled water, gave the following results compared to non-pretreated jute:

| | Reflectance (%) | $H_2O_2$ consumption (%) | Desizing, measured by the Tegewa method |
|---|---|---|---|
| Starting goods | 14.2 | — | 1 |
| Desized according to the prior art, and bleached (comparative experiment) | 39.7 | 85 | 9 |
| Pretreated according to the invention, and bleached | 52.8 | 24 | 9 |

EXAMPLE 4

A starch-sized cotton nettle, containing some iron, and weighing about 150 g/m$^2$, was impregnated with the following:

(a) Comparative experiment:
5 g/l of DIASTAFOR spec. (malt amylase)
5 g/l of common salt
3 g/l of nonylphenol oxyethylated with 10 moles of ethylene oxide (b) according to the invention:
5 g/l of DIASTAFOR spec.
5 g/l of common salt
3 g/l of nonylphenol oxyethylated with 10 moles of ethylene oxide
2 g/l of hydrosulfite
3 g/l of sodium nitrilotriacetate
1 g/l of sodium bisulfite
1 g/l of sodium sulfite The pH of the solution was 7.1 and the wet pick-up was about 60%.

After an overnight dwell at 20° C., and subsequent washing, the following data were found:

| | Content of ionic iron (mg/g of fabric) | Desizing measured by the Tegewa method |
|---|---|---|
| Starting goods | 1 | 1 |
| desized according to a) | 1 | 9 |
| desized according to b) | 0.01 | 9 |

The mixture according to the invention does not interfere with the sizing and removes the iron compounds which interfere with the subsequent peroxide bleaching.

EXAMPLE 5

A starch-sized cotton herringbone twill weighing 340 g/m$^2$ was impregnated with (a)
2 g/l of ENZYLASE HT (bacterial amylase)
1.5 g/l of hydrosulfite
2 g/l of the sodium salt of EDTA
0.75 g/l of sodium disulfite
0.75 g/l of sodium sulfite
3 g/l of nonylphenol oxyethylated with 10 moles of ethylene oxide, (b)
2 g/l of ENZYLASE HT
3 g/l of nonylphenol oxyethylated with 10 moles of ethylene oxide, squeezed to 100% wet pick-up, steamed for two minutes at 100° C. and washed. To determine the limits, the pH of the liquors was adjusted, first to pH 6 with acetic acid and then to pH 9 with ammonia.

No starch was detected after either treatment. A subsequent 20-minute peroxide bleach at 100° C. (imitation of U-box bleach, liquor ratio 1:1) using 20 ml/l of $H_2O_2$ 35%
2 g/l of NaOH
2 g/l of magnesium salt of EDTA and distilled water followed by washing and drying gave the following results:

| | Reflectance % |
|---|---|
| desired according to a) | 81.3 |

-continued

| | Reflectance % |
|---|---|
| at pH 6 | |
| desized according to a) | 81.6 |
| at pH 9 | |
| desized according to b) | 79.4 |
| at pH 6 | |
| desized according to b) | 78.9 |
| at pH 9 | |

The effect produced by the mixture according to the invention can be shown after the peroxide treatment even though the period of action is only two minutes.

EXAMPLE 6

To illustrate the wide range of application a jute fabric sized with potato starch and weighing 280 g/m$^2$ was desized with three different types of amylase:

bacterial amylase
malt amylase
pancreatic amylase at pH 6 (adjusted with acetic acid) and at pH 9 (adjusted with ammonia) using (a)

5 g/l of amylase
3 g/l of nonylphenol oxyethylated with 10 moles of ethylene oxide (b)

5 g/l of amylase
1 g/l of hydrosulfite
1.5 g/l of the sodium salt of diethylenetriamine pentaacetic acid
0.5 g/l of sodium bisulfite $NaHSO_3$
0.5 g/l of sodium sulfite
3 g/l of nonylphenol oxyethylated with 10 moles of ethylene oxide in drinking water at a liquor ratio of 40:1 for three hours at 60° C.

A subsequent peroxide bleach using 25 ml/l of $H_2O_2$ 35%
4 g/l of magnesium salt of EDTA (2 hours at 90° C., liquor ratio 40:1) in distilled water gave the following results.

| | Desizing measured by the Tegewa method | Reflectance % | Peroxide loss during bleach % |
|---|---|---|---|
| according to a. pH 6 | | | |
| BIOLASE PC 20 | 9 | 53.3 | 27 |
| DIASTAFOR spec. | 9 | 53.1 | 22 |
| DIAFERMAN A | 9 | 53.0 | 20 |

-continued

| | Desizing measured by the Tegewa method | Reflectance % | Peroxide loss during bleach % |
|---|---|---|---|
| according to b. pH 6 | | | |
| BIOLASE PC 20 | 9 | 56.6 | 7 |
| DIASTAFOR spec. | 9 | 56.1 | 6 |
| DIAFERMAN A | 9 | 58.4 | 7 |
| according to a. pH 9 | | | |
| BIOLASE PC 20 | 9 | 50.8 | 22 |
| DIASTAFOR spec. | 9 | 51.3 | 27 |
| DIAFERMAN A | 9 | 52.5 | 22 |
| according to b. pH 9 | | | |
| BIOLASE PC 20 | 9 | 58.0 | 7 |
| DIASTAFOR spec. | 9 | 58.0 | 7 |
| DIAFERMAN A | 9 | 58.8 | 7 |

We claim:

1. A process for desizing and bleaching textile goods containing, or consisting of, cellulose and sized with starch, by enzymatic desizing and subsequent treatment with hydrogen peroxide, wherein the desizing bath contains, in addition to amylase in an amount to achieve desizing, (a) from 0.1 to 10% of a dithionite
(b) from 0.2 to 10% of a heavy metal complexing agent selected from the group consisting of aminopolycarboxylic acids and salts, polyphosphates and phosphonic acids and salts, and
(c) from 0.05 to 5% of a buffer capable of maintaining the pH of the desizing bath, which has been brought to 6–9, within the same range, the above percentages being based on the weight of textile goods, the salts mentioned above under (a) and (b) being other than heavy metal salts and wherein, during the subsequent peroxide bleaching, at most 5 ml of sodium or potassium silicate of 38° Be strength are employed per liter of bleaching liquor.

2. A process as claimed in claim 1, wherein components (a), (b) and (c) are employed in a weight ratio a:b:c of 1:(0.25–4):(0.25–1.5).

3. A process as claimed in claim 1, wherein components (a), (b) and (c) are employed in a weight ratio a:b:c of 1:(0.5–2):(0.5–1).

4. A process as claimed in claim 1 wherein the dithionite is sodium dithionite.

5. A process as claimed in claim 1 wherein the buffer is a mixture of (i) sodium or potassium sulfite and (ii) sodium or potassium pyrosulfite or bisulfite.

6. A process as claimed in claim 1 wherein bacterial amylase or malt amylase is used at 75° to 20° C. for from 2 to 24 hours for the desizing.

7. A process as claimed in claim 1 wherein from 0.1 to 2% of dithionite and from 0.2 to 2% of complexing agent, both based on the weight of textile goods, are used.

8. A process as claimed in claim 1 wherein from 3 to 10 g total of components (a), (b) and (c) are used per liter of desizing bath.

9. A process as claimed in claim 1 wherein the bleaching is carried out without addition of a silicate.

* * * * *